United States Patent [19]

Lasher

[11] Patent Number: 4,574,679

[45] Date of Patent: Mar. 11, 1986

[54] RATCHET PLATE FOR CONVERSION OF A WIRE BRAIDER CARRIER TO A YARN BRAIDER CARRIER

[76] Inventor: Leroy G. Lasher, 1425 Hardy St., Levittown, Pa. 19067

[21] Appl. No.: 563,315

[22] Filed: Dec. 20, 1983

[51] Int. Cl.[4] ..... D04C 3/18

[52] U.S. Cl. ..... 87/57; 57/129; 87/55; 242/46.2

[58] Field of Search ..... 87/21, 22, 55–57; 57/129–132; 242/46.2, 46.21, 46.3, 46.4

[56] References Cited

U.S. PATENT DOCUMENTS

| | | | |
|---|---|---|---|
| 398,809 | 2/1889 | Van Valkenburg | 242/46.2 |
| 563,043 | 6/1896 | Lever et al. | 242/46.3 |
| 667,849 | 2/1901 | Morse | 242/46.3 |
| 1,517,840 | 12/1924 | Koella | 87/57 |
| 1,630,669 | 5/1927 | Mossberg | 87/22 |
| 1,740,309 | 12/1929 | Lock | 242/46.21 |
| 1,781,135 | 11/1930 | Sladek et al. | 87/22 |
| 1,817,626 | 8/1931 | Janssen | 87/22 |
| 2,933,971 | 4/1960 | Silver et al. | 87/56 |
| 4,003,290 | 1/1977 | Haehnel et al. | 87/57 |

*Primary Examiner*—John Petrakes
*Attorney, Agent, or Firm*—William Lawrence Muckelroy

[57] ABSTRACT

In a braider carrier comprising a main body adapted to move on a base of a braider, a plate rotably mounted on the main body having a ratchet on the bottom, a latch pivoted to the main body and having a pawl adapted to engage and disengage from the ratchet, a vertical operation rod extending from the main body, said rod being spring loaded and operatively connected at the lower end to said latch for pivoting movement about a guide rod for guiding one end of payed out material for braiding, the improvement comprising means for converting said braider carrier from a wire braider carrier to a yarn braider carrier by modification of the top of said plate comprising the addition of projections adapted to engage tubes onto which yarn is wound.

8 Claims, 8 Drawing Figures

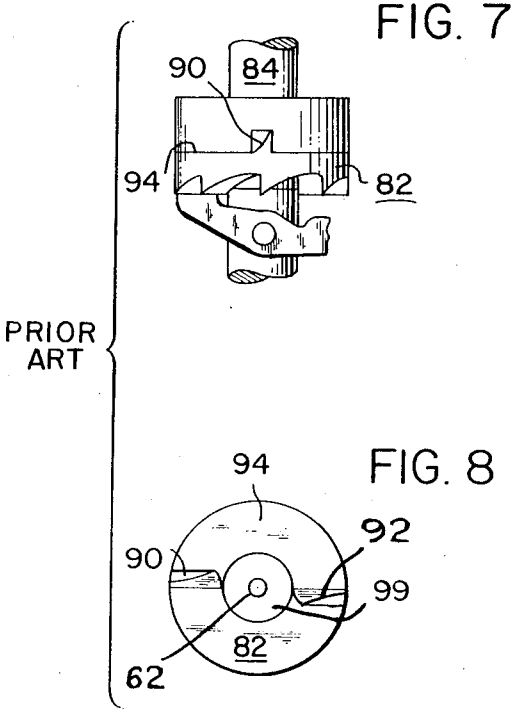
FIG. 7
FIG. 8
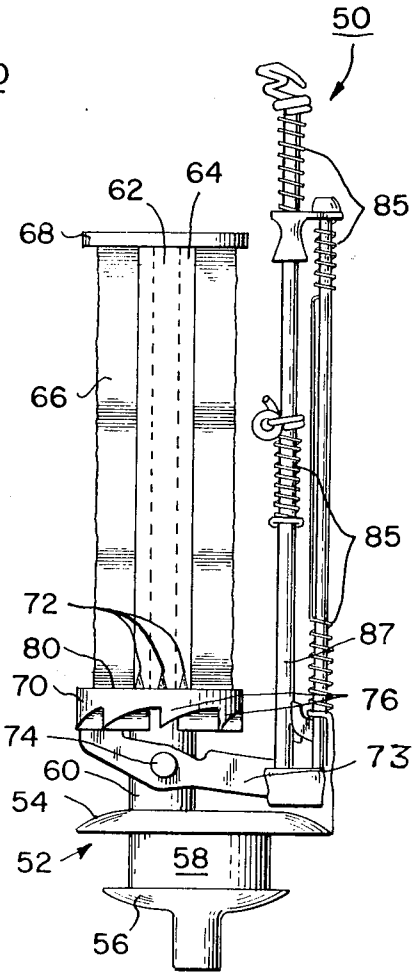
FIG. 6
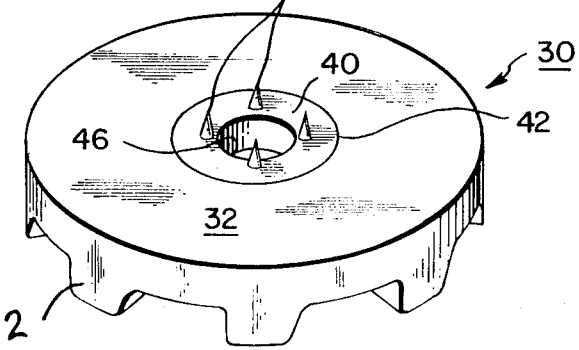
FIG. 4
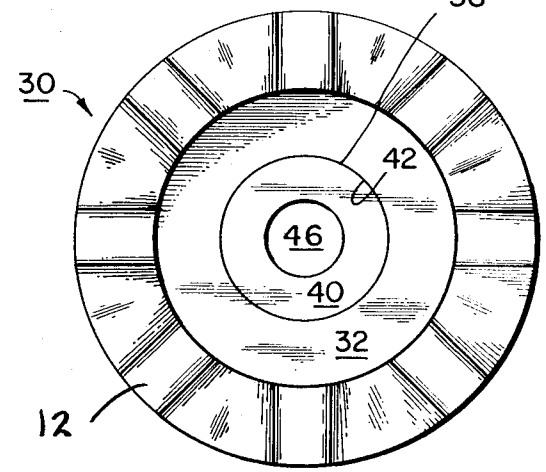
FIG. 5

RATCHET PLATE FOR CONVERSION OF A WIRE BRAIDER CARRIER TO A YARN BRAIDER CARRIER

BACKGROUND OF THE INVENTION

1. Field of the Invention

This invention relates generally to a ratchet plate for a braiding machine of the type adapted to receive bobbins, wound spools of yarn, wound spools of wire, and other wound packages in the textile machinery and wire working machinery industry, such as braiding, plating, creling, winding and spinning machinery and more particularly, to a particular design for a ratchet plate for use on machinery designed for wire braiding which will adapt it for braiding of yarn.

2. Description of the Prior Art

Braiding machines comprise a metal plate provided with tracks around which a plurality of spools of elongated materials such as yarn or wire are caused to travel. The tracks are so arranged that the carriers weave in and out of each other as they travel along the tracks thereby effectuating braiding of yarn, thread or wire carried by said bobbins or spools. Bobbin or spool carriers have for many years been made in the form of a metal base with upstanding spindles which carry a bobbin of thread or spool of yarn or wire. The base comprises a metal foot from which the pins upstand, a gear co-acting driving pin by which a driving force is supplied to the carrier and a fin positioned between the foot and the driving pin and which serves to follow one of the tracks in the metal plate. There are many thousands of such carriers in use at the present time. These carriers are either specially made for braiding wire or specially made for braiding yarn. Wire carriers have not heretofore been adaptable to receive spools of yarn for the purpose of braiding yarn instead of wire.

The invention is generally related to an improvement in braider carriers manufactured along the general construction lines of Mossberg U.S. Pat. No. 1,630,669, but specifically adapted or designed for braiding wire.

It is an object of the present invention to provide a means whereby wire braider carriers can be converted and adapted to yarn braider carriers by either modification of an existing ratchet plate adapted for wiring braiding and insertion of an adapter member into the modified ratchet plate or by replacement of the ratchet plate adapted for wire braiding on the braider with a ratchet plate specifically designed to receive, engage and drive spools of yarn.

A more specific object of the invention is to adapt a wire braider carrier to receive a yarn package comprising a paper core, whereby the yarn package with the paper core is pushed down on drive pins attached to a ratchet plate.

The above and other objects and intended advantages of the present invention will be more readily apparent to those skilled in the art from a reading of the following detailed description of the preferred embodiments of the invention in conjunction with the accompaning drawing which shows preferred embodiments of the invention for illustration purposes only, but not for limiting the scope of same in any way.

SUMMARY OF THE INVENTION

The present invention is modification to a wire braider whereby the ratchet plate of wire braider is converted and adapted to receive spools of yarn for the purpose of braiding same instead of wire.

BRIEF DESCRIPTION OF THE DRAWING

The accompanying drawing shows two preferred embodiments of the invention. One is a substitute ratchet plate comprised of plastic material for example, with metal pins imbedded therein for the purpose of driving a spool onto which yarn is wound for use in a braider carrier and the other is a ratchet plate which is modified to drive spools of yarn inserted on the spindle of a braided carrier by means of a member attached to said ratchet plate in which:

FIG. 4 is a top view of the assembled ratchet plate and converter of FIG. 3;

FIG. 5 is a bottom view of the assembled ratchet plate and converter of FIG. 3;

FIG. 6 is a front elevational view of a braider carrier in which the modified ratchet plate of the invention is incorporated;

FIG. 7 is a front elevational view of a ratchet plate of the prior art; and

FIG. 8 is a top view of a ratchet plate of the prior art.

DESCRIPTION OF THE PREFERRED EMBODIMENT OF THE INVENTION

Figure 1:
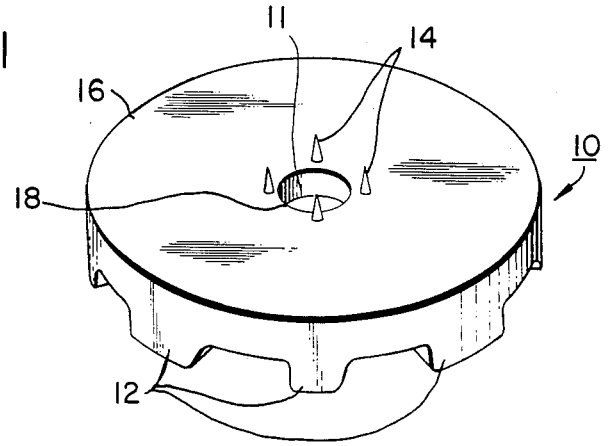
FIG. 1 is a perspective view of the novel ratchet plate for use on a braider carrier.

The present invention will now be described referring to the accompanying drawing and more particularly, to FIGS. 1 through 8 in which the first embodiment of the modified ratchet plate, a component of the invention, is shown. In FIG. 1, reference numeral 10 denotes a modified ratchet plate which is a spool drive plate formed of a wear resistant material such as metal or Teflon, for example. The ratchet plate 10 has a vertical throughhole 11 and integral ratchets 12 on the undersurface of the ratchet plate 10. Disposed about the vertical throughhole 11 are a plurality of projections 14. The ratchet plate 10 has a periphery 16 and each of the projections 14 is equally spaced away from the periphery 16. The vertical throughhole 11 has a perimeter 18. The projections 14 are also equally spaced away from the perimeter 18.

Figure 2:
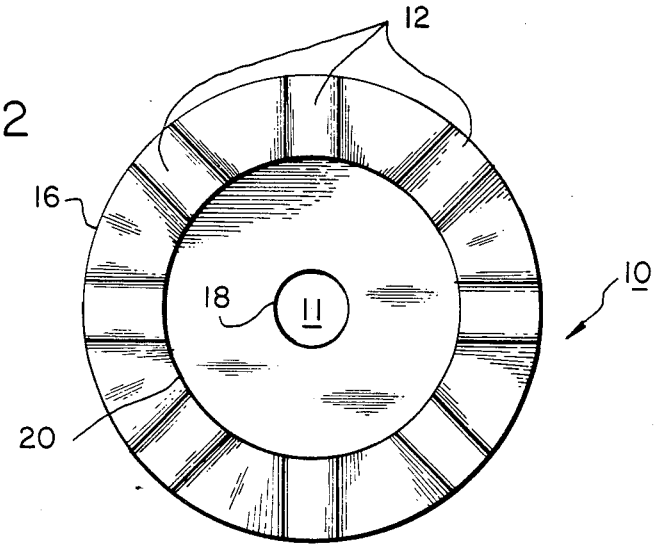
FIG. 2 is a bottom view of the ratchet plate shown in FIG. 1.

There is shown in FIG. 2 a bottom view of the ratchet plate 10 wherein each of the ratchets 12 is depicted along with the vertical throughhole 11. There is also shown in FIG. 2 the periphery 16 of the ratchet plate 10 as well as the perimeter 18 of the vertical throughhole 11. In between the perimeter 18 and the periphery 16 of the ratchet plate 10 there is an inner perimeter 20. In between the inner perimeter 20 and the outer perimeter 16 of the ratchet plate 10, are located the ratchets 12 of the ratchet plate 10.

Figure 3:
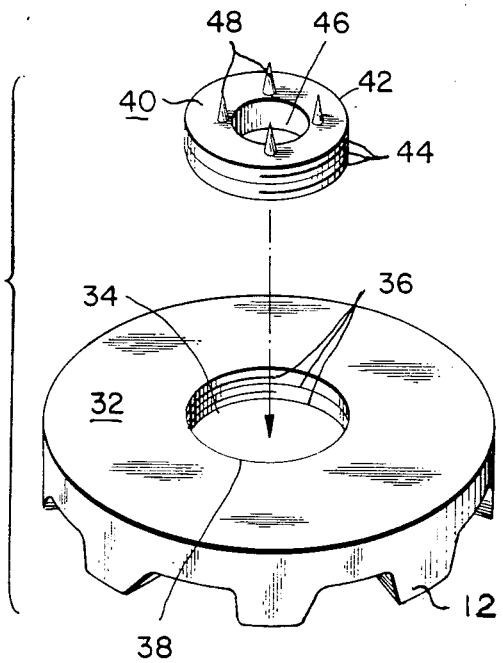
FIG. 3 is an exploded prospective view of another embodiment of the novel invention having a ratchet plate and a converter assembly.

Referring now to FIG. 3 there is shown a ratchet plate assembly 30. In the assembly 30 there is shown a modified ratchet plate 32 similar in shape, size and design to the ratchet plate 10 shown in FIG. 1. The modified ratchet plate 32 is further characterized by a vertical throughhole 34 having threads 36. The throughhole 34 has a perimeter 38. The ratchet plate assembly 30 is also made up of a converter 40. The converter 40 has a perimeter 42 and threads 44. The converter 40 is adapted to be received by the modified ratchet plate 32 inside the vertical throughhole 34 and held therein by the threads 36 and 44 adapted to engage each other. The converter 40 also has a vertical throughhole 46. The converter 40 has attached to it a plurality of similar projections 48 similar in disposition and arrangement as the vertical projections 14 shown in FIG. 1 and attached to the ratchet plate 10. Further, the vertical throughhole 46 shown in FIG. 3 is substantially similar in size to the vertical throughhole 11 of the ratchet plate 10 shown in FIG. 1.

There is shown in FIG. 4 the ratchet plate assembly 30 with the converter 40 attached to the modified ratchet plate 32. As shown the converter 40 is flush with the modified ratchet plate 30. The projections 48 extend vertically from the surface of the ratchet plate assembly 30.

Shown in FIG. 5 is a bottom view of the ratchet plate assembly 30 also shown in FIG. 4.

The ratchet plate assembly 30 shown in FIGS. 3, 4 and 5 is substantially the same in mechanical function and appearance as the ratchet plate 10 shown in FIG. 1. The perimeter 38 of the ratchet plate 32 in FIG. 3 is substantially the same as the perimeter 42 of the converter 40 which is attached to the ratchet plate 32. As shown in FIG. 5 the converter 40 when attached to the modified ratchet plate 32 has its underside substantially flush with the underside of the modified ratchet plate 32.

FIG. 6 shows a braider carrier 50 incorporating the improved ratchet plate of the invention. The braider carrier 50 has a base 52 with flanges 54 and 56 to engage the upper and lower sides of a plate (not shown) of a braiding machine (not shown) while a web 58 travels in a serpentine raceway (not shown) of the plate of the braiding machine (not shown). A boss 60 extends upwardly from the base 52 with a spindle 62 extending from the boss 60. A paper tube 64 having wound thereon yarn 66 is mounted on the spindle 62. The spindle 62 has a head 68 which is removable and re-attachable to the spindle 62 for the purpose of allowing the insertion and removal of the tube 64 with yarn 66 thereon.

Mounted about the spindle 62 and on top of the boss 60 is a ratchet plate 70 having attached thereto means for converting said braider carrier 50 from a wire braider to a yarn braider carrier. This means comprises projections 72, actually painted conically shaped spikes which are substantially similar to the projections 48 depicted in FIG. 4 and the projections 14 depicted in FIG. 1. The ratchet plate 70 is substantially similar in design as the ratchet plate 10 shown in FIGS. 1 or 4 and functions in substantially the same manner. The plate 70 is shown herein in combination with a wire braider carrier 50.

A pawl 73 is pivoted about an attachment pin 74, for example, whereby the attachment pin 74 attaches the pawl 73 to the boss 60 and pivots on the boss 60. Pawl 73 engages ratchets 76 of the ratchet plate 70 in the usual performance of the braider carrier 50.

The projections 72 are disposed about a face 80 of the ratchet plate 70 so as to engage and penetrate a tube 64 of paper or the like utilized to store wound yarn 66 and the tube 64 with the yarn 66 thereon is inserted over the spindle 62. The ratchet plate 70 may comprise plastic and the projection 72 may be made of metal pins embedded in the plastic.

Ratchet plate 70 is different from the prior art in that the projections 72 are specially adapted to engage tube 64 made of paper or similar type material for which the projections 72 are adapted to easily penetrate. More so, the projections 72 are disposed in a circular pattern about the face 80 of the ratchet plate 70 such that the disposition of the projections 72 about the face 80 is substantially congruent to the perimeter of the tube 64. Accordingly, the projections 72 are disposed so as not to interfere with or engage any of the yarn 66 wound about the tube 64 but instead each projection has a limited cross section which does not exceed the cross sectional width of the tube 64.

In the prior art as shown in FIGS. 7 and 8, an unmodified ratchet plate 82 is shown engaging a bobbin 84 with a projection 90 and a projection 92 (shown in FIG. 8). The projections 90 and 92 depicted in FIG. 8 are teeth which extend across the entire top face 94 of the ratchet plate 82. In the novel invention the projections 90 and 92 are removed and the face 94 of the ratchet plate 82 is modified by means of an adapter such as, for example, the converter 40 shown in FIG. 3. In the improvement, the converter 40 is adapted to fit into the interior of the ratchet plate 82 of the prior art shown in FIG. 8 and to be flush with the face 94 of the ratchet plate 82. The converter 40 is sized so as to fit over the spindle 62, shown in FIG. 6, and yet provide for the disposition of projections 72 around the spindle 62 such as, for example, projections 72 on the surface of the ratchet plate 70 as shown in FIG. 6.

The converter 40 shown in FIGS. 3 and 4 may be adapted to be attached to a modified ratchet plate 82 as shown in FIG. 8 and in FIG. 2 by threading the outside of the converter 40 in such a manner as to adapt it to be screwed into threads established by drilling and tapping the throughhole 99 of the ratchet plate 84 (shown in FIG. 8).

In operation, the braider carrier shown in FIG. 6 typically incorporates the bobbin 84 shown as prior art in FIG. 7. Wire extends from the bobbin 84 to a guide means incorporated in the braider carrier 50 of FIG. 6 and then into a cable (not shown) being braided. As the braider carrier 50 rotates about the cable, the braiding operation occurs. As the braider carrier 50 rotates about the cable (not shown) whether the cable is made of yarn or wire, tension in the wire or yarn will increase and the pawl 73 will be moved axially with the bore 60 and against springs of the braider carrier 50 shown generally at 85 in FIG. 6. After displacement by a predetermined extent, the pawl 73 the braider carrier operates to displace an actuating rod 87 thereby disengaging the pawl 73 which permits delatching of the ratchet plate 70 shown in FIG. 6. Such disengagement will allow rotation of the tube 64 attached to the ratchet plate 70 (or of the bobbin 84 shown in FIG. 7 for the prior art). The disengagement allows the rotation of a bobbin 84 (see FIG. 7) on the spindle 62 or rotation of the tube 64 of yarn 66 on the spindle 62 as shown in FIG. 6 and, in turn, a reduction in tension of either the yarn or wire. As a consequence of the disengagement the springs push the rod 87 and allows the rod 87 to return to its initial position, thereby effectuating re-engagement of the pawl 73 with the ratchet teeth 76 of the ratchet plate 70. In FIG. 6 this action results in breaking of the rotation of the ratchet plate 70 and of the tube 64 of yarn 66 attached thereto. In the prior art in FIG. 7 this mechanism breaks the rotation of the bobbin 84 with wire (not shown) thereon.

As shown by FIG. 6, it has been found that by means of projections suitably sized, disposed and mounted on a ratchet plate such as 70 wherein the projections 72 are specifically oriented so as to engage and penetrate only the tube 64 on which yarn 66 is wound, this novel ratchet plate in combination with a standard wire braider carrier converts same to operate effectively as a braider carrier for yarn. These specific embodiments for the ratchet plate as modified and hereto afore described is as a ratchet plate with a plurality of projections specially disposed to engage and penetrate a paper tube on which yarn is wound.

As a direct consequence of the use of a converted or modified ratchet plate such as described herein, the conversion from a wire carrier to a yarn carrier is inexpensively enabled.

Further, the cost of purchasing yarn carriers and the cost of changing from wire carriers to yarn carriers is significantly reduced. Further, since machines which are designed for use only as yarn carriers are generally fragile and require much more maintenance than wire braider carriers, as a consequence of this invention, yarn carriers which are more durable and less expensive to maintain are quickly and economically created.

Further, since the existing ratchet plate of the prior art such as that shown in FIG. 7 as 82 may be easily modified to effectuate this invention, this creates a significant cost advantage for conversion from a wire carrier to a yarn carrier and also for re-conversion to a wire carrier since re-conversion simply requires the replacement of a ratchet plate such as 82 in FIG. 7 on the modified braided carrier 50 in FIG. 6.

The invention is not to be restricted to the particular features of the embodiments hereinbefore described since alternatives will readily present themselves to one of ordinary skill in the art.

What is claimed is:

1. In a wire braider carrier of the kind having a base, a spindle having an upper end and a lower end, said lower end being attached to said base, a ratchet plate on said spindle having an upper face and a lower face with ratchets thereon, means for latching and de-latching said ratchet plate attached to the lower end of said spindle, means for engaging a means for storing elongated material attached to said ratchet plate, the improvement wherein said means for storing elongated material comprises a penetrable paper tube having a cross-sectional width with yarn thereon, means for penetrating said tube wherein said means for penetrating said tube comprises a plurality of pointed projections extending from said upper face, each said projection having a cross-section which is less than the cross-sectional width of said tube, said projections being adapted and disposed to penetrate an end of said tube.

2. The braider carrier of claim 1 wherein said projections are disposed in a pattern wherein said projections engage only said tube.

3. The braider carrier of claim 2 wherein said projections are conically shaped spikes attached to the upper face of said ratchet plate.

4. The braider carrier of claim 3 wherein said ratchet plate comprises an annular piece having a threaded aperture therein and a cylindrical threaded member adapted to be screwed inside the aperture of said annular piece.

5. The braider carrier of claim 4 wherein said projections consist of metal.

6. In a wire braider carrier of the kind having a base, a spindle having an upper end and a lower end, said lower end being attached to said base, a ratchet plate on said spindle having an upper face and a lower face with ratchets thereon, means for latching and delatching said ratchet plate attached to the lower end of said spindle, means for engaging a means for storing elongated material attached to said ratchet plate, the improvement comprising pointed means for engaging a tubular spool comprised of paper or the like, said spool having an end and adapted to hold yarn, said means being attached to said upper face of said ratchet plate.

7. The braider carrier of claim 6 wherein said ratchet plate has an outer periphery and wherein said means for engaging comprises a plurality of projections arranged equidistant from said outer periphery toward said spindle and disposed to engage and penetrate said end.

8. The braider carrier of claim 7 wherein said ratchet plate is comprised of a plastic-like material and wherein said projections each consist of metal-like material wherein each said projection is embedded in said plastic-like material.

* * * * *